US005164535A

United States Patent [19]

Leasure

[11] Patent Number: 5,164,535

[45] Date of Patent: Nov. 17, 1992

[54] GUN SILENCER

[75] Inventor: John D. Leasure, Saluda, Va.

[73] Assignee: Silent Options, Inc., Saluda, Va.

[21] Appl. No.: 755,634

[22] Filed: Sep. 5, 1991

[51] Int. Cl.[5] ..... F41A 21/30

[52] U.S. Cl. ..... 89/14.4; 181/223

[58] Field of Search ..... 89/14.2, 14.4; 181/223

[56] References Cited

U.S. PATENT DOCUMENTS

| | | | |
|---|---|---|---|
| 1,173,687 | 2/1916 | Thompson | 89/14.4 |
| 2,503,491 | 4/1950 | Janz | 181/41 |
| 3,667,570 | 6/1972 | WerBell, III | 181/36 R |
| 4,341,283 | 7/1982 | Mazzanti | 89/14.4 |
| 4,576,083 | 3/1986 | Seberger | 89/14.4 |
| 4,588,043 | 5/1986 | Finn | 181/223 |
| 4,907,488 | 3/1990 | Seberger | 89/14.4 |
| 4,974,489 | 12/1990 | Fishbaugh | 89/14.4 |
| 4,977,815 | 12/1990 | Stephens | 89/180 |
| 5,036,747 | 8/1991 | McClain | 89/14.3 |

FOREIGN PATENT DOCUMENTS

| | | | |
|---|---|---|---|
| 373439 | 10/1939 | Italy | 89/14.2 |
| 216888 | 7/1925 | United Kingdom | 89/14.2 |

*Primary Examiner*—Stephen C. Bentley

*Attorney, Agent, or Firm*—Griffin Butler Whisenhunt & Kurtossy

[57] ABSTRACT

A gun silencer (10) comprises an outer tube (16) having disk-shaped baffles (18) separated by intermediate spacers (20, 23, 25, 27) therein having bores through which discharge from a muzzle (14) of a gun barrel (12) travels. The baffles include rear beveled diversion passage pairs (48*a* and *b*) adjacent to and leading from front ports (56) into baffle bores (46) and front beveled diversion passage pairs (50*a* and *b*) leading from the baffle bores to rear ports (58) in intermediate spacers leading to outer chambers (even numbers 76–88) formed between the intermediate spacers, the baffles, and the outer tube. A bore (28) of the tube is threaded along its entire length. Front and rear faces 40 and 42 of baffles are knurled.

13 Claims, 1 Drawing Sheet

GUN SILENCER

BACKGROUND OF THE INVENTION

This invention relates broadly to gun silencers and more specifically to gun silencers of a type including an outer tube having baffles and intermediate spacers mounted therein.

There are a number of gun silencers on the market having various baffles and intermediate spacers mounted in outer tubes thereof; however, many of these gun silencers do not achieve an adequate noise attenuation. Also, some of them are quite heavy, thereby disturbing gun balance and preventing automatic and semi-automatic weapons from properly cycling. Yet another difficulty with many types of prior-art gun silencers is that they work well only with particular sizes of ammunition. That is, for example, one type of silencer may work well for 38 caliber ammunition, however, it does not work well for 22 caliber ammunition.

In addition, many prior art gun silencers do not significantly reduce muzzle flash.

Also, some prior-art gun silencers include an undue number of different types of parts and/or are difficult to assemble thereby making them expensive to manufacture and quite costly for ultimate consumers.

Yet another difficulty with most prior art silencers is that they employ "wipes" or other components that require replacement after as few as 20 or 30 rounds.

It is, therefore, an object of this invention to provide a durable gun silencer which adequately reduces gun noise while simultaneously cycling automatic and semi-automatic guns, preventing muzzle flash, not being unduly heavy, working with most sizes of ammunition, having a small number of different parts, being easily assembled, and being relatively inexpensive to manufacture.

SUMMARY

According to principles of this invention, a gun silencer includes an outer tube having at least one baffle mounted in a tube bore thereof, the baffle defining a beveled diversion passage pair adjacent to and leading into a baffle bore, with each diversion passage of the diversion passage pair being beveled in a discharge direction and being directed substantially radially. In a preferred embodiment the diversion passages of the diversion passage pairs are directed from and toward ports in intermediate spacers positioned between a plurality of adjacent baffles which lead to circumferential, or outer, chambers. The bore of the outer tube is threaded along the entire length thereof and front and rear faces of the baffles are knurled. There are a plurality of baffles and intermediate spacers clamped together within the outer tube by members screwed in the threads of the tube bore.

BRIEF DESCRIPTION OF THE DRAWING

The foregoing and other objects, features and advantages of the invention will be apparent from the following more particular description of a preferred embodiment of the invention, as illustrated in the accompanying drawings in which reference characters refer to the same parts throughout the drawings. The drawings are not necessarily to scale, emphasis instead being placed upon illustrating principles of the invention in a clear manner.

DESCRIPTION OF A PREFERRED EMBODIMENT

Figure 1:
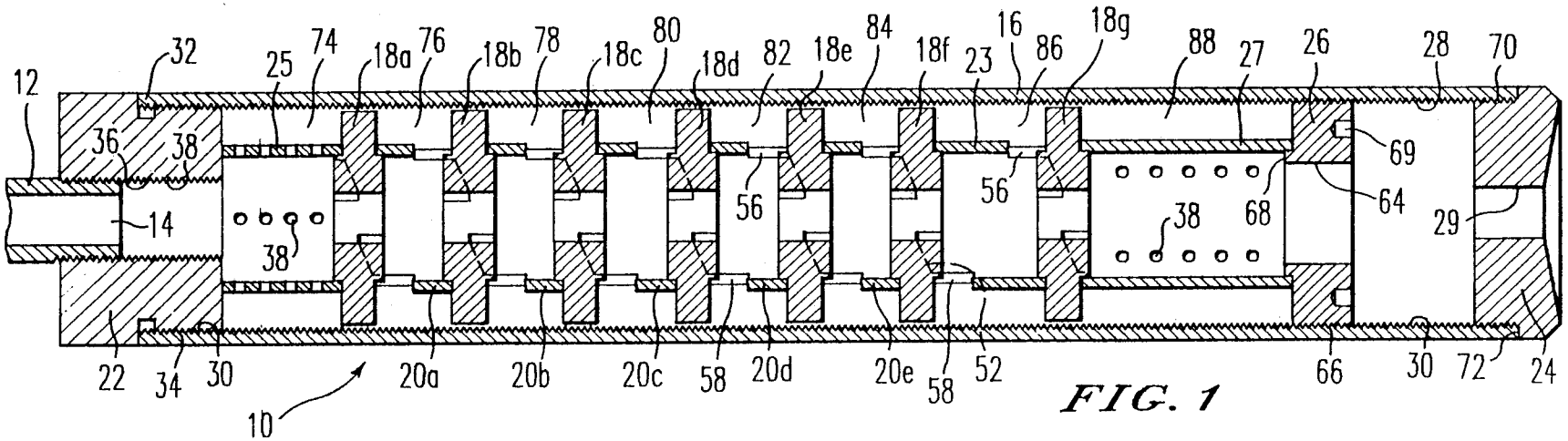
FIG. 1 is a cross-sectional view of a gun silencer of this invention mounted on a gun barrel.

A gun silencer 10 for .38 caliber gun is mounted on a gun barrel 12 at its muzzle 14. The gun silencer 10 comprises an outer tube 16, seven ¼ inch baffles 18*a*–18*g*, five ½ inch intermediate spacers 20*a*–*e*, a ¾ inch front intermediate spacer 23, a ¾ inch rear spacer 25, a 1¼ inch front spacer 27, a cylindrical rear cap 22, a cylindrical front cap 24, and a threaded, cylindrical, lock ring 26. Each of these members has a bore therethrough which, when the gun silencer 10 is mounted on the gun barrel 12, is aligned with the muzzle 14 so that discharge from the muzzle 14 will travel through its respective bore to exit from a front cap bore 29. In one embodiment these members are constructed of hardened steel, however, they can be constructed of steel, alloy, plastics and/or ceramics.

The outer tube 16 is nine inches long with an inner diameter of 1.55 inches, however, it should be noted that the dimensions of most components of the silencer of this invention will change depending upon the size of a gun on which it is mounted. It is knurled on a portion of an outer surface thereof so that it can be easily gripped and rotated. The tube bore 28 is threaded with a single directional female spiral thread 30 along the entire length of the tube 16, however, it should be understood that the thread 30 could be a right-hand thread part of the length of the tube and a left hand thread another part of the length of the tube.

The rear cap 22 is screwed into a rear end 32 of the outer tube 16 with male threads 34 thereof, while female threads 36 in a cap bore 38 screw onto external, male threads cut on the gun barrel 12. The rear spacer 25 is cylindrically shaped, although it need not be, having an inner diameter of approximately 0.86 inches in the embodiment described herein. There are four rows of ⅛ inch ports 38, each row spaced 90 degrees from adjacent rows. The front spacer 27 is similarly configured as is the rear spacer 25 with the exception that the front spacer 27 is 1¼ inches long whereas the rear spacer 25 is only ¾ inches long and the front spacer 27 has only three rows of five ports, or holes, each row being spaced 120 degrees apart. Although the port arrangement described herein for the rear and front spacers 25 and 27 appears to work quite well, this port arrangement is not critical.

Figure 4:
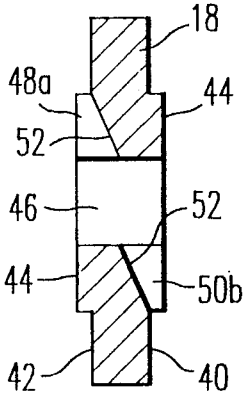
FIG. 4 is a cross-sectional view taken on line 4—4 in FIG. 3.
Figure 3:
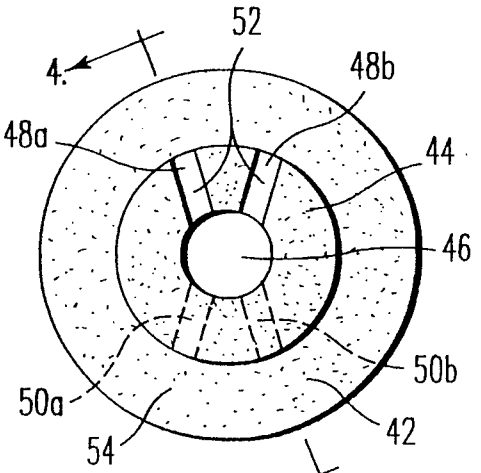
FIG. 3 is a front plan view of the baffle of FIG. 2.
Figure 2:
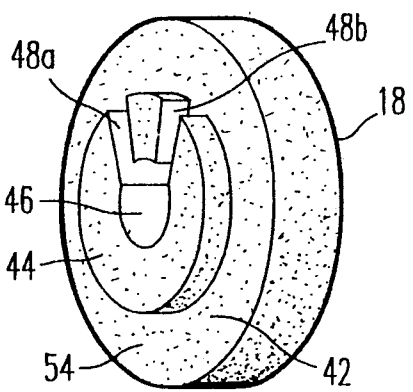
FIG. 2 is an isometric view of a baffle which is part of the gun silencer of FIG. 1.

Each of the baffles 18*a*–*g* (designated only as 18 in FIGS. 2–4, with all baffles 18*a*–*g* being identical) is in the shape of a relatively thin circular disk having an outer peripheral diameter of 1.4 inches. The front and rear faces 40 and 42 of each of the baffles includes an annularly-shaped centering protrusion 44 having an outer diameter of approximately 0.86 inches which projects snugly into the bores of all of the intermediate spacers 20*a*–*e*, 25 and 27, each of which has an internal diameter of approximately 0.86 inches. The centering protrusion 44 for each of the baffles 18*a*–*g* surrounds the baffle bore 46 which has a diameter of 0.390 inch.

Formed into the front and rear faces 40, 42 of the baffle 18 are rear and front diversion passage pairs 48*a* and *b* and 50*a* and *b*. Each diversion passage of each pair is substantially separated from the other diversion passage of the pair. Each of the diversion passages is partially defined by a beveled surface 52 which is beveled in a bullet-discharge direction along the outer tube 16. That is, gases coming from the muzzle 14 toward the front cap 24 will strike the beveled surfaces 52 of the rear diversion passages 48*a* and *b* and be diverted inwardly, from a front port 56 of a previous intermediate spacer toward a center of the baffle bore 46. Gases thusly diverted by the diversion passages 48*a* and *b* will intersect approximately near the center of the baffle bore 46. The beveled surfaces 52 of the diversion passages 50*a* and *b* on the front side of each of the baffles 18 are beveled outwardly so that gases which have passed through the baffle bore 46 can move from the center thereof radially outwardly on the front face 40 of the baffle 18 toward a rear port of a subsequent intermediate spacer. Once gases pass through the baffle bore 46 some of them pass into the rear port 58 of the following spacer but the balance of the gases go to the rear face of the next baffle. It should also be noted that centers of the rear diversion passages 48*1* and *b* on the rear side of the baffle 18 are 180 degrees from the front diversion passage pair 50*a* and *b* so that the rear diversion passages 48*a* and *b* are directed toward the front diversion passages 50*a* and *b* whereby discharge gases directed by the rear diversion passages 48*a* and *b* are directed to intersect in the baffle bore 46 and then pass along the front diversion passages 50*a* and *b* generally toward the rear port in the spacer. The front and rear faces 40 and 42 of the baffle 18 are knurled as indicated at 54 in FIGS. 2 and 3. This knurling, or roughening, 54 helps to disrupt gas flow, cool gases, and thereby serves to dampen noise. It should be noted that the baffles 18 are symmetrical so that the front and rear faces thereof are interchangeable. Thus, the baffles 18*a–g* can be turned around without changing their configurations.

Figure 5:
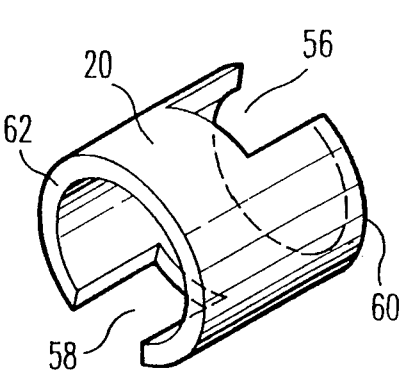
FIG. 5 is an isometric view of a intermediate spacer which is part of the gun silencer of FIG. 1.

Each of the half inch intermediate spacers 20*a–e* are identical and therefore only one of these members is depicted in more detail in FIG. 5. In the depicted embodiment the half inch intermediate spacers 20 are basically cylindrical in shape (although they need not be) having ⅛ inch front and rear ports 56 and 58 at front and rear edges 60 and 62 thereof. These ports 56 and 58 are depicted in FIG. 5 as being slot-shaped, however, they could also be circular. It is noted that the front and rear ports 56 and 58 are positioned on 180 degree centers from one another and that these members are symmetrical so that the front and rear ends thereof can be reversed. As can be seen in FIG. 1, the intermediate spacers 20 are positioned so that their front and rear ports 56 and 58 are respectively positioned adjacent to rear and front diversion passages 48*a* and *b* and 50*a* and *b* of adjacent baffles 18.

The front intermediate spacer 23 is the same as the intermediate spacers 20 with the exception that it is ¾ inches long rather than ½ inch long.

A lock-ring bore 64 of the lock ring 26 is 0.5 inches in diameter and an outer periphery of the lock ring 26 is 1.5 inches and threaded with male threads 66 which are engageable with the female threads 30 of the tube bore 28. The lock ring 26 includes an annular centering protrusion 68 thereon having an outer diameter of 0.86 inches so that it fits snugly in the 0.86 bore of the front spacer 27.

The front cap 24 of the silencer also has male threads 70 for meshing with the female threads 30 of the tube bore 28 and includes a shoulder 72 for engaging a front edge of the outer tube 16.

Describing now operation of the gun silencer 10, the gun silencer is assembled by screwing the rear cap 22 into the rear end 32 of the outer tube 16. The interior members, or "guts", of the gun silencer 10 are then assembled on the lock ring 26 external of the outer tube 16 by stacking the front spacer 27, the baffle 18*g*, the front intermediate spacer 23, alternately a baffle and then a intermediate spacer thereon to include six baffles 18*f–a* and five intermediate spacers 20*e–a*, and finally the rear spacer 25 on the baffle 18*a*. This entire stack is held vertical while a front end of the outer tube 16 is placed thereover until the male threads 66 of the lock ring 26 engage the female threads 30 of the outer tube. Thereafter, either the tube 16 or the stack is rotated so that the stack is moved further into the tube until a rear end of the rear spacer 25 contacts a front face of the rear cap 22. At this point, the lock ring 26 is tightened further, using grip indentations 69, to hold the entire stack clamped between the rear cap 22 and the lock ring 26 in the position shown in FIG. 1. It should be understood that this assembly sequence could be varied in order to achieve the structure depicted in FIG. 1. Finally, the front cap 24 is screwed into the front end of the outer tube 16.

To use the gun silencer 10, in one embodiment, male threads are cut on the gun barrel 12 and the female threads 36 of the rear cap 22 are screwed thereon. Of course the silencer could be attached to the gun by other means.

The silencer described above is suitable for use with a gun which shoots a 38 caliber bullet, thus, the bores of the baffles 18 are 390 inch, the lock ring bore 64 is 0.5 inch, and the front cap bore 29 is 0.421 inch, all of which allow sufficient clearance for 38 caliber bullets to pass therethrough. Gases discharged from the muzzle 14 are allowed to expand into various circumferential outer chambers 74, 76, 78, 80, 82, 84, 86, 88, defined by the outer tube 16 and the interior members, which aids in muffling, or dampening, noise broadcast from the gun muzzle. In this regard, expanding gases can pass through the ports 38 in the rear spacer 25 and the front spacer 27. But even more specifically, such gases are separated and diverted by the pairs of the separated front and rear diversion passages 50*a* and *b* and 48*a* and *b* from the front ports 56 toward the rear ports 58 of the intermediate spacers 20*a–e*, and the front intermediate spacer 23.

The rear diversion passages 48*a* and *b* help to exhaust the front ports 56 of the preceding spacers and the front diversion passages 50*a* and *b* help to direct gases to the rear ports 58 of the next spacers.

It has been found that by having diversion passage pairs in baffles which cause separate gas flows to intersect in baffle bores, noise is thereby significantly reduced. Further, when such diversion passage pairs are directed generally toward ports in intermediate spacers, so that the gases are diverted into outer, or circumferential, chambers, noise is reduced in an uncomplicated way to a greater extent than would have normally been expected.

It has also proven to be quite beneficial to knurl the facing surfaces of the baffles because in this manner in a particularly uncomplicated and cost effective manner energy is dissipated so that noise is reduced by the gun silencer of this invention to yet a greater extent.

Similarly, it has also been found to be quite beneficial to have a female thread 30 along the entire bore of the outer tube 16 because this thread allows additional surface area for heat absorption.

Whereas many prior art silencers have components that must be replaced after as few as 20 or 30 rounds, the silencer of this invention will normally last the life of a host weapon.

Also, a silencer of this invention will cycle automatic and semiautomatic guns, which many silencers will not.

One benefit of the gun silencer of this invention is that it can be used with a wide size range of ammunition. For example, basically the same silencer can be used for 22 caliber ammunition as well as 50 caliber ammunition. In fact, the silencer of this invention will effectively function for 22 caliber to 50 caliber ammunition, although some dimensions must be changed to physically accommodate different size ammunition and gun barrels.

A further benefit of this invention is that it not only serves as a gun silencer but also serves to suppress muzzle flash.

It is also beneficial that the gun silencer of this invention employs a small number of different types of parts and in that many of these parts can be used in opposite orientations so that the parts thereof can be cost effectively manufactured and assembled into the gun silencer of this invention.

Yet another benefit of this invention is that it is quite light, adding very little weight to a gun on which it is mounted. This allows this invention to cycle the action of most automatic and semiautomatic weapons.

While the invention has been particularly shown and described with reference to a preferred embodiment, it will be understood by those skilled in the art that various changes in form and detail may be made therein without departing from the spirit and scope of the invention. For example, the diversion passages 48*a* and *b* or 50*a* and *b* of a diversion passage pair will be angularly separated from one another to a greater extent for larger ammunition guns in that these passages are generally directed toward the centers of the baffles 18. Thus, if the baffle bore 46 were larger, the diversion passages would have to be separated by a greater angle in order to still be directed toward the center of the baffle. For example, for 22 caliber ammunition the diversion passages are separated by about 45 degrees whereas for 38 caliber ammunition they are separated by about 60 degrees.

Also, it should be understood that the silencer depicted and described herein is a 38 caliber silencer and the dimensions given herein relate to such a silencer. Most of the component sizes are different in other caliber silencers, although the dimensions given herein also apply to a 9 mm silencer.

Further, although the tubular spacers described and depicted for this invention are basically cylindrical in shape it would be possible to construct some or all of these members to have other cross-sectional shapes, such as square or hexagonal.

Although the inventive silencer depicted and described herein is screwed to a gun barrel, it is possible to have a gun silencer of this invention form an integral part of a gun barrel or be mounted, or attached in other manners.

The embodiments of the invention in which an exclusive property or privilege are claimed or defined as follows:

1. A gun silencer comprising:

an outer tube including a gun-barrel mounting means for mounting a rear end of the outer tube to a gun barrel at a muzzle thereof, said outer tube defining a tube bore along a length thereof aligned with discharges from said muzzle when said outer tube is mounted on said gun barrel; and a baffle mounted inside said outer tube, said baffle including a baffle bore aligned with discharges from said muzzle when said outer tube is mounted on said gun barrel, said baffle including a rear face defining a beveled diversion passage pair adjacent to and leading into said baffle bore, each diversion passage of said diversion passage pair defining a surface beveled in a discharge direction, being substantially separated from adjacent diversion passages in a circumferential direction, and being directed substantially radially.

2. A gun silencer as in claim 1 wherein there are at least two pairs of diversion passages, one pair on the front face and one on the rear face of said baffle, said pairs on said front and rear face being circumferentially approximately spaced on 180 degree centers from one another.

3. A gun silencer as in claim 2 wherein there are at least first and second baffles with said diversion passage pairs thereon and wherein is further included a intermediate spacer member between said baffles said intermediate spacer member being substantially smaller than an inner dimension of said outer tube and outer peripheral dimensions of said baffles, whereby an outer chamber is defined between said baffles, an outer surface of said intermediate spacer member, and an inner surface of said outer tube and wherein said intermediate spacer member defines at least one port at a rear end thereof adjacent a diversion passage pair on a front side of said first baffle.

4. A gun silencer as in claim 3 wherein said intermediate spacer member has a second port spaced on approximately a 180 degree center from the first port near an opposite, front end thereof which is located adjacent a rear diversion passage pair of the said second baffle.

5. A gun silencer as in claim 4 wherein front and rear facing surfaces of the said baffles are knurled.

6. A gun silencer as in claim 5 wherein said tube bore is spirally threaded substantially along its entire length.

7. A gun silencer as in claim 1 wherein said tube bore is spirally threaded substantially along its entire length.

8. A gun silencer comprising:

an outer tube including a gun-barrel attachment means for attaching a rear end of the outer tube to a gun barrel at a muzzle thereof, said outer tube defining a tube bore along a length thereof aligned with discharge from said muzzle when said outer tube is mounted on said gun barrel a plurality of baffles mounted inside said outer tube each of said baffles including a baffle bore aligned with discharges from said muzzle when said outer tube is mounted on said gun barrel, said each baffle including a front and rear face, with each face defining a beveled diversion passage adjacent to and leading into said baffle bore, each diversion passage defining a surface beveled in a discharge direction and being directed substantially radially, the diversion passage on the front face being circumferentially spaced a substantial distance from the diversion passage on the rear face;

at least one intermediate spacer member positioned between the baffles, said intermediate spacer member being substantially smaller than an inner dimension of the outer tube and an outer peripheral dimension of the baffles whereby an outer chamber is defined between the baffles, and outer surface of the intermediate spacer member, and an inner surface of the outer tube, the intermediate spacer member defining a front port at a front end thereof and a rear port at a rear end thereof, said rear and front ports being positioned a substantial distance from one another and being respectively located adjacent to the front and rear diversion passages of the first and second baffles.

9. A gun silencer as in claim 8 wherein front and rear facing surfaces of the baffles are knurled.

10. A gun silencer as in claim 9 wherein said tube bore is spirally threaded along its entire length.

11. A gun silencer as in claim 8 wherein said tube bore is spirally threaded along its entire length.

12. A gun silencer as in claim 8 wherein the diversion passages on the front and rear faces and the rear and front ports are spaced on approximately 180° centers from one another.

13. A gun silencer comprising:

an outer tube including a gun-barrel attachment means for attaching a rear end of the outer tube to a gun barrel at a muzzle thereof, said outer tube defining a tube bore along a length thereof aligned with discharges from said muzzle when said outer tube is mounted on said gun barrel; and a plurality of baffles mounted inside said outer tube, each of said baffles including a baffle bore aligned with discharges from said muzzle when said outer tube is mounted on said gun barrel, each of said baffles including a front face and a rear face;

a plurality of intermediate spacer members positioned between said baffles, said intermediate spacer members being substantially smaller than inner dimensions of said outer tube and outer peripheral dimensions of said baffles whereby an outer chamber is defined between said faces of said baffles, outer surfaces of said intermediate spacer member, and an inner surface of said outer tube and wherein each of said intermediate spacer members defines at least one port therethrough;

wherein said front and rear faces of said baffles are knurled.

* * * * *